US011804323B2

(12) United States Patent
Gibu

(10) Patent No.: US 11,804,323 B2
(45) Date of Patent: Oct. 31, 2023

(54) ELECTRONIC COMPONENT

(71) Applicant: Murata Manufacturing Co., Ltd., Kyoto-fu (JP)

(72) Inventor: Minoru Gibu, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 530 days.

(21) Appl. No.: 17/037,395

(22) Filed: Sep. 29, 2020

(65) Prior Publication Data

US 2021/0098177 A1 Apr. 1, 2021

(30) Foreign Application Priority Data

Sep. 30, 2019 (JP) ..... 2019-179955

(51) Int. Cl.

| | |
|---|---|
| ***H01F 27/28*** | (2006.01) |
| ***H01F 27/255*** | (2006.01) |
| ***H01F 41/04*** | (2006.01) |
| ***H01F 27/29*** | (2006.01) |

(52) U.S. Cl.

CPC ..... *H01F 27/255* (2013.01); *H01F 27/29* (2013.01); *H01F 41/04* (2013.01)

(58) Field of Classification Search

CPC ..... H01F 27/255; H01F 27/29; H01F 41/04; H01F 1/26; H01F 27/022; H01F 17/04; H01F 2017/048; H01F 27/28

USPC ..... 336/233, 232, 200

See application file for complete search history.

(56) References Cited

U.S. PATENT DOCUMENTS

| | | | | |
|---|---|---|---|---|
| 2015/0380151 | A1* | 12/2015 | Choi | H01F 41/041 336/200 |
| 2018/0061551 | A1* | 3/2018 | Kondou | H01F 27/29 |
| 2019/0115127 | A1* | 4/2019 | Iso | H01F 41/041 |
| 2020/0168391 | A1* | 5/2020 | Yang | H01F 17/0013 |
| 2020/0335253 | A1* | 10/2020 | Yeo | H01F 27/2852 |

FOREIGN PATENT DOCUMENTS

| | | | |
|---|---|---|---|
| JP | 2005-166745 A | | 6/2005 |
| JP | 2005166745 A | * | 6/2005 |

* cited by examiner

*Primary Examiner* — Shawki S Ismail
*Assistant Examiner* — Kazi S Hossain
(74) *Attorney, Agent, or Firm* — Studebaker & Brackett PC

(57) ABSTRACT

An electronic component includes a marker excellent in visibility and prevented from peeling off. That is, an electronic component is provided with an element body having a conductor inside; an insulating film and at least one marker disposed on a surface of the element body; and an external electrode disposed on the element body or the insulating film. The marker is exposed on a surface of the electronic component, and when the maximum height of the marker on the surface of the element body on which the marker is disposed is $M_{max}$ and the maximum height of the insulating film is $I_{max}$, $M_{max}$ and $I_{max}$ satisfy the following expression: $M_{max} \leq I_{max}$.

16 Claims, 3 Drawing Sheets

ELECTRONIC COMPONENT

CROSS-REFERENCE TO RELATED APPLICATION

This application claims benefit of priority to Japanese Patent Application No. 2019-179955, filed Sep. 30, 2019, the entire content of which is incorporated herein by reference.

BACKGROUND

Technical Field

The present disclosure relates to an electronic component.

Background Art

Conventionally, an electronic component such as a coil component is provided with a marker for the purpose of identifying a position and/or a direction.

Japanese Patent Application Laid-Open No. 2005-166745 discloses a laminated inductor having a spiral coil conductor in a rectangular parallelepiped chip obtained by laminating and firing a large number of sheet layers, and having a marker layer for indicating the position of an extended portion of the coil conductor on each of the inside of an upper-surface-side sheet layer and the inside of a lower-surface-side sheet layer constituting the chip. Each marker layer has a rectangular shape having the same width as the chip, two sides on the chip-side-surface side of each marker layer are exposed on two side surfaces of the chip, and one side on the chip-end-surface side is located inside a predetermined distance from the end surface of the chip.

SUMMARY

The marker of the electronic component is required to have higher visibility. Further, it is desirable that the marker is unlikely to peel off in the manufacturing process of the electronic component, the conveying process of the completed electronic component, and the mounting process of the electronic component.

Therefore, the present disclosure provides an electronic component including a marker excellent in visibility and prevented from peeling off.

As a result of intensive studies, the present inventors have found that the visibility of the marker is improved and the peeling of the marker is prevented by controlling the position where the marker is disposed in the electronic component and the thickness of the marker.

According to one gist of the present disclosure, there is provided an electronic component including an element body having a conductor inside; an insulating film and at least one marker disposed on a surface of the element body; and an external electrode disposed on the element body or the insulating film. The marker is exposed on a surface of the electronic component, and when the maximum height of the marker on the surface of the element body on which the marker is disposed is $M_{max}$ and the maximum height of the insulating film is $I_{max}$, $M_{max}$ and $I_{max}$ satisfy the following expression:

$$M_{max} \leq I_{max}.$$

According to the electronic component of the present disclosure, the visibility of the marker can be enhanced and the peeling of the marker can be prevented.

DETAILED DESCRIPTION

Hereinafter, electronic components according to embodiments of the present disclosure will be described in detail with reference to the drawings. However, the embodiments described below are for the purpose of illustration, and the present disclosure is not limited to the following embodiments.

Various numerical ranges referred to in the present specification are intended to include the lower and upper numerical values themselves. As a matter of course, when the terms "or more" and "or less" are used, even when those are not used, numerical values themselves are included unless otherwise explained. Taking a numerical range such as 1 to 10 as an example, it is interpreted as including both the lower limit value "1" and the upper limit value "10."

First Embodiment

Figure 1:
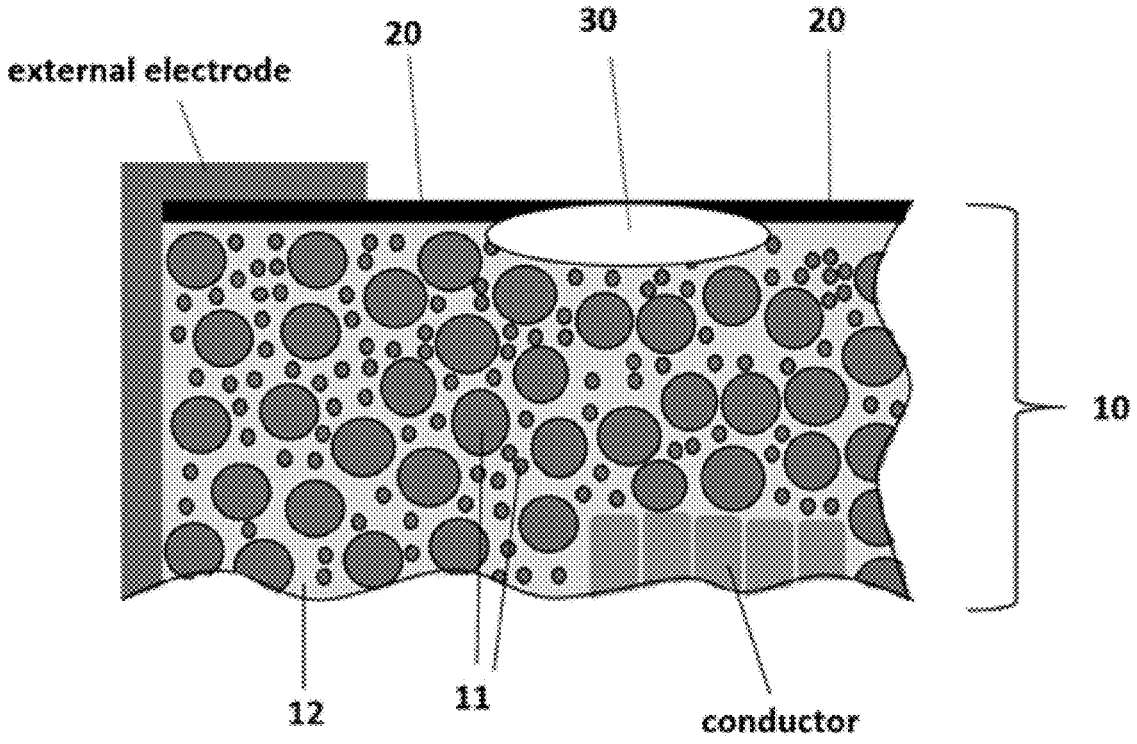
FIG. 1 is a partial cross-sectional view schematically illustrating a marker in an electronic component according to a first embodiment of the present disclosure.

An electronic component according to a first embodiment of the present disclosure includes an element body having a conductor inside, an insulating film and at least one marker disposed on the surface of the element body, and an external electrode disposed on the element body or the insulating film. FIG. 1 is a partial cross-sectional view schematically illustrating the shape and placement of the marker. As illustrated in FIG. 1, an insulating film 20 and at least one marker 30 are disposed on the surface of an element body 10. Hereinafter, a case where the electronic component is a coil component such as an inductor will be mainly described as an example, but the electronic component according to the present embodiment is not limited to the coil component, and the present disclosure can be applied to various electronic components.

The marker 30 is exposed on the surface of the electronic component. When the maximum height of the marker 30 on the surface of the element body 10 on which the marker 30 is disposed is $M_{max}$ and the maximum height of the insulating film 20 is $M_{max}$ and $I_{max}$ satisfy the following expression:

$$M_{max} \leq I_{max}.$$

Figure 2:
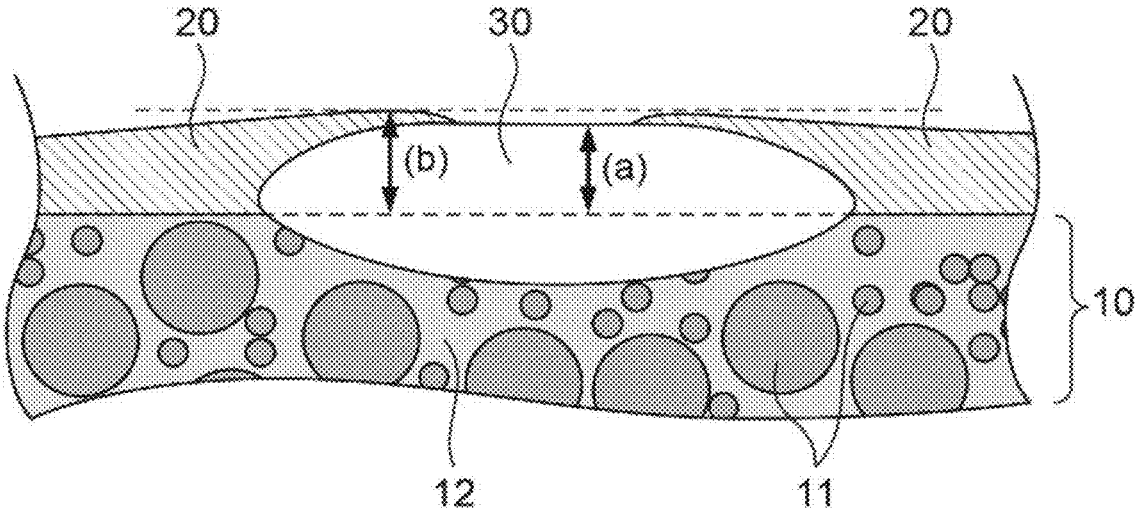
FIG. 2 is a partial cross-sectional view schematically illustrating the maximum height of the marker and the maximum height of the insulating film.

Here, the maximum height $M_{max}$ of the marker 30 on the surface of the element body 10 means the height of the marker 30 at the position where the height of the marker 30 from the surface of the element body 10 becomes maximum in a cross-sectional view (a cross-sectional view in a direction perpendicular to the surface of the element body 10 on which the marker 30 is disposed). Similarly, the maximum height $I_{max}$ of the insulating film 20 on the surface of the element body 10 means the height of the insulating film 20 at the position where the height of the insulating film 20 from the surface of the element body 10 becomes maximum in a cross-sectional view. More specifically, as illustrated in FIG. 2, the maximum height $M_{max}$ of the marker 30 means the height at the position where the height (distance) of the surface of the marker 30 from the surface of the element body 10 on which the marker 30 is disposed is the highest (indicated by symbol (a)). Similarly, the maximum height $I_{max}$ of the insulating film 20 means the height at the position where the height (distance) of the surface of the insulating film 20 from the surface of the element body 10 on which the insulating film 20 is disposed is the highest (indicated by symbol (b)). The maximum height $M_{max}$ of the marker 30 and the maximum height $I_{max}$ of the insulating film 20 can be measured by a method described below. First, the electronic component is cut to form a cross section. This cross section is processed by ion milling. The processed cross section is observed with a scanning electron microscope (SEM). The magnification of the SEM is preferably set to about 500 to 5000 times. In the obtained SEM image, the maximum height $M_{max}$ of the marker 30 and the maximum height $I_{max}$ of the insulating film 20 can be measured to obtain the values of $M_{max}$ and $I_{max}$.

In the electronic component according to the present embodiment, the marker 30 is exposed on the surface of the electronic component. With the marker 30 being exposed from the insulating film 20, the marker 30 can be easily identified on the surface of the electronic component, and the visibility of the marker 30 is excellent. The identification of the marker 30 can be performed using, for example, a camera and/or a sensor. In the electronic component according to the present embodiment, the maximum height $M_{max}$ of the marker 30 is equal to or less than the maximum height $I_{max}$ of the insulating film 20. For example, in the configuration illustrated in FIG. 1, the maximum height $M_{max}$ of the marker 30 is the same as the maximum height $I_{max}$ of the insulating film 20, and in the configuration illustrated in FIG. 2, the maximum height $M_{max}$ of the marker 30 is smaller than the maximum height $I_{max}$ of the insulating film 20. As thus described, when the maximum height $M_{max}$ of the marker 30 is equal to the maximum height $I_{max}$ of the insulating film 20 or less than $I_{max}$, the marker 30 is resistant to external impact and/or sliding, so that the strength against external impact and/or sliding is improved, and as a result, the peeling of the marker 30 is prevented.

Figure 4:
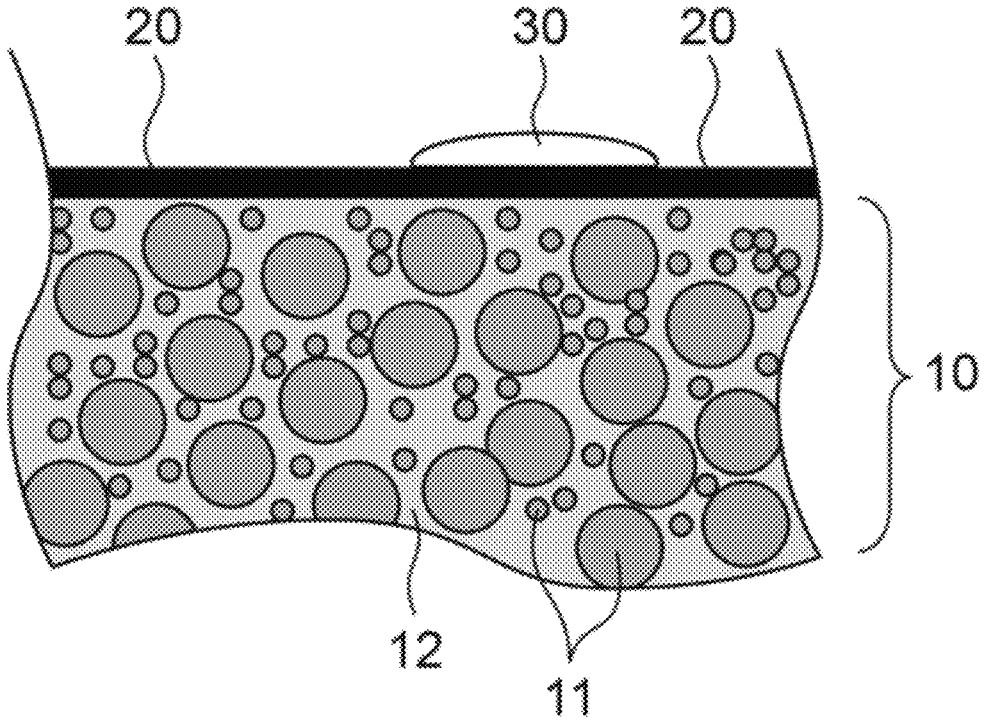
FIG. 4 is a partial cross-sectional view schematically illustrating a conventional marker.

In contrast, as illustrated in FIG. 4, when the maximum height of the marker 30 is greater than the maximum height of the insulating film 20 (i.e., the marker 30 protrudes from the surface of the insulating film 20), the marker 30 is directly exposed to external impact and/or sliding, so that the marker 30 tends to peel off more easily than the configuration of FIGS. 1 and 2.

Figure 5:
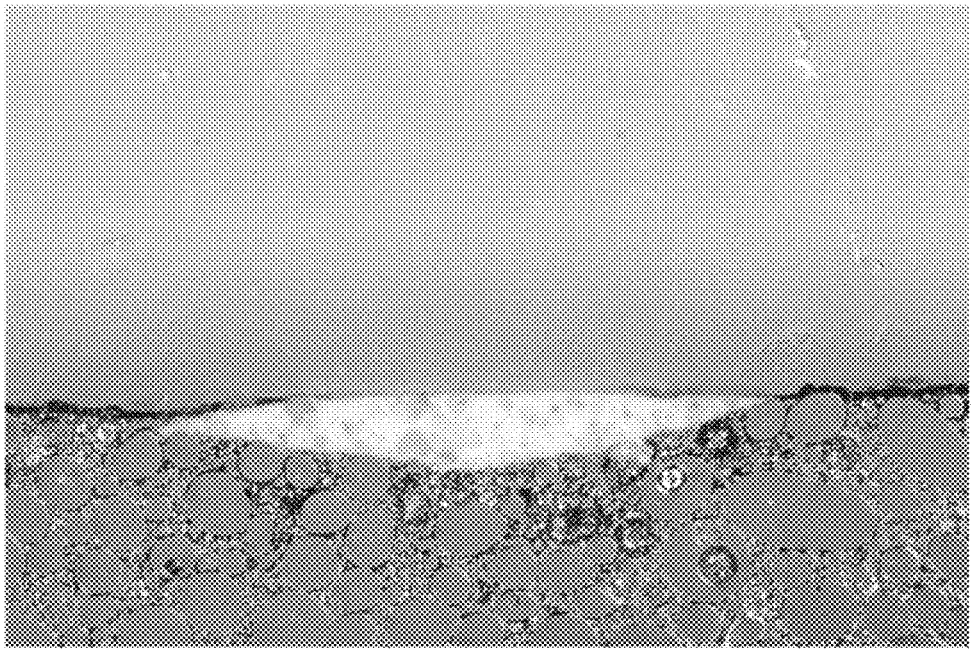
FIG. 5 is an optical microscope image of a cross section of an electronic component according to the present disclosure.

FIG. 5 illustrates an optical microscope image of the cross section of the electronic component according to the present embodiment. As illustrated in FIG. 5, the marker 30 (white portion) is exposed on the surface of the electronic component, and the maximum height $M_{max}$ of the marker 30 is equal to or less than the maximum height $I_{max}$ of the insulating film 20.

Hereinafter, each element constituting the electronic component according to the present embodiment will be described in more detail.

(Element Body 10)

The element body 10 may have a substantially rectangular parallelepiped shape, for example. In the present specification, the term "rectangular parallelepiped" includes a cube, and the term "substantially rectangular parallelepiped" includes a rectangular parallelepiped which is rounded at least at one of its corners and ridge line portions. When the element body 10 has a substantially rectangular parallelepiped shape, the outer dimensions of the element body 10 may be, for example, a length (L) of 1.1 mm or more and 1.6 mm or less (i.e., from 1.1 mm to 1.6 mm), a width (W) of 0.6 mm or more and 1.4 mm or less (i.e., from 0.6 mm to 1.4 mm), and a thickness (T) of 0.5 mm or more and 0.8 mm or less (i.e., from 0.5 mm to 0.8 mm).

(Metal Magnetic Powder 11)

Figure 3:
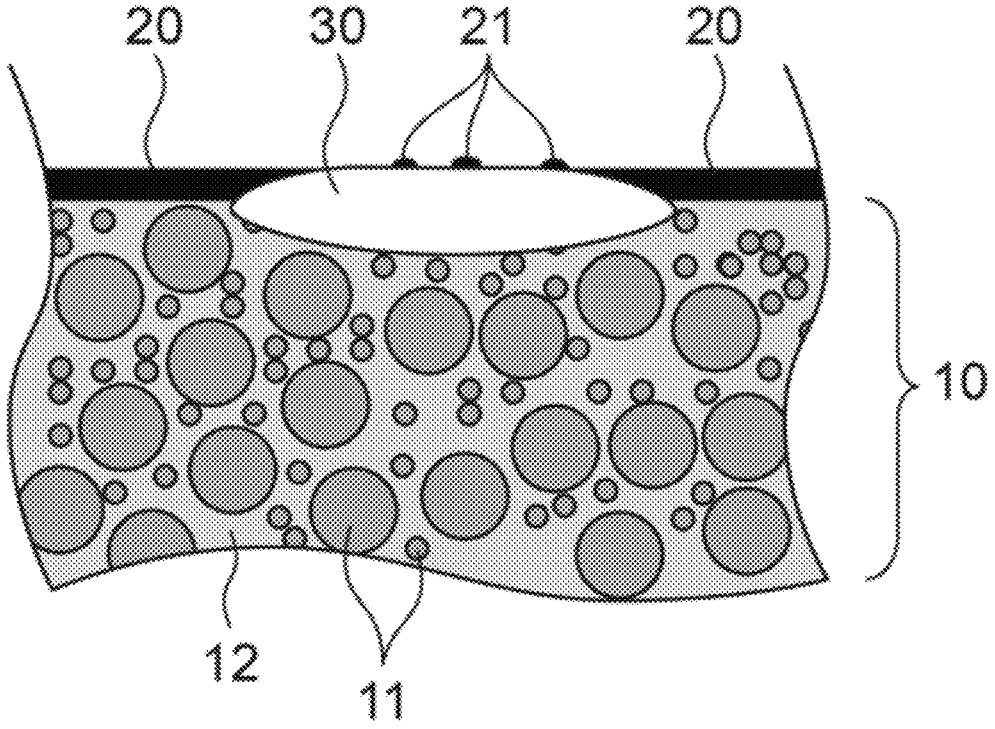
FIG. 3 is a partial cross-sectional view schematically illustrating a marker in an electronic component according to a second embodiment of the present disclosure.

The element body 10 preferably contains metal magnetic powder 11. When the element body 10 contains the metal magnetic powder 11, the insulating film 20 can be selectively formed on the surface of the element body by a method described later. A metal magnetic material contained in the metal magnetic powder 11 may be, for example, crystalline or amorphous Fe (pure iron) or Fe alloy (Fe—Si alloys, Fe—Si—Cr alloy, Fe—Si—Al alloy, Fe—Al alloy, etc.). The average particle size of the metal magnetic powder 11 is not particularly limited but may be, for example, 1 μm or more and 50 μm or less (i.e., from 1 μm to 50 μm). As illustrated in FIGS. 1 to 3, the element body 10 may contain two or more kinds of metal magnetic powder 11 having different average particle sizes, but the element body 10 may contain only one kind of metal magnetic powder 11. The metal magnetic powder 11 may have an insulating film on its surface. The content of the metal magnetic powder 11 in the element body 10 is not particularly limited but may be 60 wt % or more and 100 wt % or less (i.e., from 60 wt % to 100 wt %) based on the overall weight of the element body 10.

The average particle size of the metal magnetic powder 11 can be measured by a method described below. First, a cross section of the electronic component is formed by the same method as described above with respect to the measurement of $M_{max}$ and $I_{max}$, and processed by ion milling. The processed cross section is observed with a scanning electron microscope (SEM). The magnification of the SEM is preferably set to about 500 to 5000 times. The particle size (circle equivalent diameter) of the metal magnetic powder 11 is measured from the obtained SEM image, and the average value thereof can be set as the average particle size of the metal magnetic powder 11. Note that the average particle size of the metal magnetic powder 11 contained in the element body 10 of the finished electronic component may be considered to be substantially the same as the average particle size of a raw material metal magnetic powder. The average particle size of the metal magnetic powder of the raw material can be obtained by measuring a volume-based median diameter D50 by a laser diffraction/scattering method.

The content of the metal magnetic powder 11 in the element body 10 can be measured by a method described below. First, a cross section of the electronic component is formed by the same method as described above with respect to the measurement of $M_{max}$ and $I_{max}$, and processed by ion milling. Time-of-flight secondary ion mass spectrometry (TOF-SIMS), X-ray photoelectron spectroscopy (XPS), or energy-dispersive X-ray analysis (EDX) is performed on the processed cross section. When the cross section of the electronic component is analyzed, carbon (C) is detected due to the composition of a resin component in a region where a resin is present, whereas C is hardly contained in a region where the resin is not present. Therefore, the content of the metal magnetic powder 11 can be calculated based on the magnitude of the area of the region where C is not detected in the cross section of the electronic component.

The average particle size of the metal magnetic powder 11 present near the surface of the element body 10 is preferably smaller than the average particle size of the metal magnetic powder 11 present at the center of the element body 10. Here, "near the surface" of the element body 10 means a region where the distance (depth) from the surface of the element body 10 in the direction perpendicular to the surface of the element body 10 is 100 μm or less, and the "center" of the element body 10 means a region inside a region near the surface of the element body 10. When the average particle size of the metal magnetic powder 11 present near the surface of the element body 10 is smaller than the average particle size of the metal magnetic powder 11 present at the center of the element body 10, the unevenness on the surface of the element body 10 can be reduced, whereby the insulating film 20 can be more uniformly formed on the surface of the element body 10. As a result, when the external electrode is formed by plating as described later, the growth of plating on the surface of the element body 10 can be further prevented.

(Resin 12)

The element body 10 preferably further contains a resin 12. The type of the resin 12 is not particularly limited, and the resin 12 may be, for example, one or more resins selected from the group consisting of epoxy resins, phenol resins, polyester resins, polyolefin resins, Si resins, acrylic resins, polyimide resins, polyvinyl butyral resins, cellulose resins, alkyd resins, and the like.

The element body 10 may further contain inorganic particles. The inorganic particles may be, for example, particles made of one or more materials selected from the group consisting of carbon black, borosilicate glass, TiO, $ZrO_2$, $SiO_2$, ZnO, and $Al_2O_3$.

(Conductor)

The element body 10 has a conductor inside. The type of the conductor is not particularly limited but can be selected as appropriate in accordance with the type of the electronic component. For example, when the electronic component is a coil component such as an inductor, the conductor is a coil conductor. The coil conductor is preferably made of a metal conductor such as Ag or Cu.

(Insulating Film 20)

The insulating film 20 is disposed on the surface of the element body 10. The insulating film 20 has a function of improving at least one of moisture resistance, insulation properties, chemical resistance, and friction resistance of the electronic component. In the present specification, an "insulating film" in a broad sense means a film having insulation properties higher than that of the element body 10 (i.e., a film having a high electrical resistance), and in a narrow sense means a film having a volume resistivity of $10^6$ Ω cm or more. The composition of the insulating film 20 is not particularly limited but can be selected as appropriate in accordance with the application and the like. The insulating film 20 may contain, for example, a resin such as an acrylic resin, an epoxy resin, a polyimide resin, a silicone resin, a polyamideimide resin, a polyetheretherketone resin, a fluorine resin, or an acrylic silicone resin. Note that the composition of the insulating film 20 is different from the composition of the element body 10.

The insulating film 20 preferably contains an inorganic filler. When the insulating film 20 contains an inorganic filler, the unevenness can be imparted to the surface of the insulating film 20, and as a result, the glossiness of the insulating film 20 can be lowered. The glossiness of the insulating film 20 can be controlled by adjusting the particle size and content of the inorganic filler contained in the insulating film 20. By adjusting the particle size and content of the inorganic filler contained in the insulating film 20 so that the glossiness of the insulating film 20 and the glossiness of the marker 30 have different values, the discriminability of the marker can be further improved. The insulating film 20 can be colored by adding a pigment as an inorganic filler to the insulating film 20. By adding a pigment to the insulating film 20 to make the color tone of the insulating film 20 different from the color tone of the marker 30, the discriminability of the marker 30 can be further improved. The inorganic filler contained in the insulating film 20 is preferably inorganic particles and may be, for example, particles made of one or more inorganic materials selected from the group consisting of carbon black, borosilicate glass, $TiO_2$, $ZrO_2$, $SiO_2$, ZnO, and $Al_2O_3$. The average particle size (D50) and content of the inorganic filler contained in the insulating film 20 are not particularly limited but, for example, the average particle size of the inorganic filler may be 1 nm or more and 10 μm or less (i.e., from 1 nm to 10 μm), and the content of the inorganic filler may be 1 wt % or more and 30 wt % or less (i.e., from 1 wt % to 30 wt %) based on the total weight of the insulating film 20.

(Marker 30)

The marker 30 is disposed on the surface of the element body 10. The marker 30 is for making the orientation (direction) of the electronic component, the extended position of the conductor inside the element body 10, and/or the like identifiable from the appearance of the electronic component (e.g., an identification marker for orientation identification). The number, position, shape, and the like of the markers 30 provided on the electronic component are not particularly limited but can be adjusted as appropriate in accordance with the application and the like. The electronic component may have only one marker 30 or may have two or more markers. The marker 30 may be, for example, a circle, an ellipse, or a polygon such as a triangle or a square.

The marker 30 is preferably in contact with the element body 10. When the marker 30 is in direct contact with the element body 10, the contact area between the marker 30 and the element body 10 increases, so that the adhesion between the marker 30 and the element body 10 is improved. As a result, the durability of the marker 30 against external stress is improved to further prevent the peeling of the marker 30.

At least a part of the outer edge of the marker 30 is preferably covered with the insulating film 20. In other words, at least a part of the outer edge of the marker 30 and the insulating film 20 preferably overlap each other when viewed from the direction perpendicular to the surface of the element body 10. Here, the "outer edge" of the marker 30 means the outer edge of the marker 30 when viewed from the direction perpendicular to the surface of the element body 10 on which the marker 30 is disposed. When at least a part of the outer edge of the marker 30 is covered with the insulating film 20, the marker 30 is more resistant to external impact and/or sliding, so that the strength against external impact and/or sliding is further improved, and as a result, the peeling of the marker 30 is further prevented. When at least a part of the outer edge of the marker 30 is covered with the insulating film 20, the surface of the marker 30 may be flush with the surface of the insulating film 20 as illustrated in FIG. 1, and the surface of the insulating film 20 may protrude outward from the surface of the marker 30 as illustrated in FIG. 2.

At least a part of the marker 30 is preferably buried in the element body 10. For example, in the configuration illustrated in FIG. 1, the bottom surface side (the side in contact with the element body 10) of the marker 30 is buried in the element body 10. When at least a part of the marker 30 is buried in the element body 10, the strength of the marker 30 against external impact and/or sliding is further improved, and as a result, the peeling of the marker 30 is further prevented. When at least a part of the marker 30 is buried in the element body 10, the maximum height of the marker 30 from the surface of the element body 10 can be lowered. When the overall dimensions of the electronic component are the same, the smaller the maximum height of the marker 30 from the surface of the element body 10, the greater the dimensions of the element body 10 can be made. When the electronic component is a coil component such as an inductor, the greater the dimensions of the element body 10 containing the metal magnetic powder, the better the inductance acquisition efficiency can be, and the better the magnetic characteristics of the coil component can be. Therefore, when at least a part of the marker 30 is buried in the element body 10, the magnetic characteristics of the coil component can be improved.

The dimensions of the marker 30 are not particularly limited but can be adjusted as appropriate in accordance with the application thereof, the outer dimensions of the element body 10, and the like. For example, when the element body 10 has a substantially rectangular parallelepiped shape and the outer dimensions of the element body 10 are 1.1 mm or more and 1.6 mm or less (i.e., from 1.1 mm to 1.6 mm) in length (L), 0.6 mm or more and 1.4 mm or less (i.e., from 0.6 mm to 1.4 mm) in width (W), and 0.5 mm or more and 0.8 mm or less (i.e., from 0.5 mm to 0.8 mm) in thickness (T), the marker 30 having a diameter or one side length of 0.1 mm or more and 0.4 mm or less (i.e., from 0.1 mm to 0.4 mm) is preferably disposed on at least one surface of the element body 10.

The ratio of the area of the marker 30 to the area of the surface of the element body 10 on which the marker 30 is disposed is preferably 10% or more and 50% or less (i.e., from 10% to 50%). Here, the "area" of the marker 30 means an area of the marker 30 when viewed from the direction perpendicular to the surface of the element body 10 on which the marker 30 is disposed, and the area of the marker 30 includes an area of a region (outer edge, etc.) in which the marker 30 is covered with the insulating film 20 or an insulating material 21 to be described later. When the area ratio of the marker 30 is 10% or more and 50% or less (i.e., from 10% to 50%), the adhesive strength between the marker 30 and the element body 10 becomes higher, and the peeling of the marker 30 is further prevented.

The marker 30 is preferably not present at the outer edge of the surface of the element body 10 on which the marker 30 is disposed. In other words, the marker 30 is preferably disposed inside the outer edge of the surface of the element body 10 on which the marker 30 is disposed. The outer edge of the surface of the element body 10 corresponds to the ridge line portion of the element body 10. The ridge line portion of the element body 10 is susceptible to external impact and the like in the manufacturing process of the electronic component, the conveying process of the completed electronic component, and the mounting process of the electronic component. Therefore, when the marker 30 is disposed so as not to reach the outer edge of the surface of the element body 10 (i.e., the ridge line portion of the element body 10), the marker 30 is even more resistant to an impact and the like from the outside, and as a result, the peeling of the marker 30 can be further prevented.

The marker 30 is preferably exposed on the surface of the electronic component when viewed in the direction perpendicular to the surface of the element body 10 on which the marker 30 is disposed. In this case, the visibility of the marker 30 becomes higher.

When viewed from the direction perpendicular to the surface of the element body 10 on which the marker 30 is disposed, the periphery of the marker 30 is preferably surrounded by the insulating film 20. As described above, the maximum height $M_{max}$ of the marker 30 on the surface of the element body on which the marker 30 is disposed is equal to or less than the maximum height $I_{max}$ of the insulating film. Thus, when the periphery of the marker 30 is surrounded by the insulating film 20 having the maximum height $I_{max}$ that is equal to or greater than the maximum height $M_{max}$ of the marker 30, the marker 30 is more resistant to external impact and/or sliding, so that it is more resistant to external impact and/or sliding, thereby further preventing the peeling of the marker 30.

The marker 30 preferably has insulation properties. In the present specification, "having insulation properties" in a broad sense means that the insulation properties are higher (i.e., the electric resistance is higher) than that of the element body 10, and in a narrow sense means that the volume resistivity is $10^6$ Ω cm or more. In the case of the external electrode is formed by plating as described later, when the marker 30 has insulation properties, the growth of plating on the surface of the marker 30 can be further prevented.

The marker 30 preferably contains an inorganic filler containing one or more materials selected from the group consisting of borosilicate glass, $TiO_2$, $SiO_2$, ZnO, $ZrO_2$, and $Al_2O_3$. More specifically, the marker 30 may contain, for example, the inorganic filler containing 10 wt % or more and less than 30 wt % (i.e., from 10 wt % to 30 wt %) of borosilicate glass, 50 wt % or more and 80 wt % or less (i.e., from 50 wt % to 80 wt %) of $TiO_2$, and a balance may contain at least one of $ZrO_2$ and $Al_2O_3$. The composition of the inorganic filler and the content of the inorganic filler in the marker 30 can be measured by analyzing the marker 30 by time-of-flight secondary ion mass spectrometry (TOF-SIMS), X-ray photoelectron spectroscopy (XPS), energy-dispersive X-ray spectroscopy (EDX), high-frequency inductively coupled plasma optical emission spectrometry (ICP-AES), high-frequency inductively coupled plasma mass spectrometry (ICP-MS), or fluorescence X-ray spectroscopy (XRF).

When the element body 10 contains the metal magnetic powder 11 and the marker 30 contains an inorganic filler, the average particle size of the inorganic filler contained in the marker 30 is preferably 30% or more and 70% or less (i.e., from 30% to 70%) of the average particle size of the metal magnetic powder 11. When the average particle size of the inorganic filler contained in the marker 30 is within the above range, the surface of the marker 30 can be made smooth, and as a result, the visibility of the marker 30 can be further improved. The average particle size of the inorganic filler can be measured in the same manner as in the above-described method for measuring the average particle size of the metal magnetic powder 11. The marker 30 may be colored by adding a pigment as an inorganic filler to the marker 30. By adding a pigment to the marker 30 to make the color tone of the marker 30 different from the color tone of the insulating film 20, the discriminability of the marker 30 can be further improved. When the color tone of the marker 30 and the color tone of the insulating film 20 are made different by adding a pigment, the pigment may be added only to either the marker 30 or the insulating film 20, or the pigment may be added to both the marker 30 and the insulating film 20.

(External Electrode)

The shape and position of the external electrode are not particularly limited, but the shape and position of the external electrode can be selected in accordance with the application. The external electrode may be, for example, a so-called five-face electrode provided on both end surfaces and some of four surfaces adjacent to both end surfaces of the element body 10, an L-shaped electrode, or a bottom electrode. The external electrode may contain, for example, one or more metals selected from the group consisting of Ag, Cu, Pd, Ni, and Sn. The external electrode can be formed by any method, for example, by applying a conductive paste containing metal particles to the element body 10 and firing the applied conductive paste. The external electrode may further include a plating layer.

Second Embodiment

Next, an electronic component according to a second embodiment of the present disclosure will be described with reference to FIG. 3. The electronic component according to the second embodiment has the same configuration as that of the electronic component according to the first embodiment except that the insulating material 21 is disposed on an exposure surface where the marker 30 is exposed on the surface of the electronic component. Hence the insulating material 21 will be mainly described below, and descriptions of other structures will be omitted. The electronic component according to the second embodiment can enhance the visibility of the marker and prevent the peeling of the marker, similarly to the electronic component according to the first embodiment.

(Insulating Material 21)

In the electronic component according to the second embodiment, the insulating material 21 is disposed on the exposure surface where the marker 30 is exposed on the surface of the electronic component. The insulating material 21 is separated from the insulating film 20. When the insulating material 21 is disposed on the exposure surface of the marker 30, the insulating material 21 may act as a buffer against external impact and/or sliding. Thus, when the insulating material 21 is disposed on the exposure surface of the marker 30, the marker 30 may be more resistant to external impact and/or sliding, and the strength of the marker 30 against external impact and/or sliding may be more improved. As a result, the peeling of the marker 30 can be further prevented. The ratio of the area occupied by the insulating material 21 can be adjusted as appropriate so as not to disturb the visibility of the marker 30. The composition of the insulating material 21 may be the same as that of the insulating film 20. Note that the composition of the insulating material 21 is different from that of the marker 30.

[Method for Manufacturing Electronic Component]

A method of manufacturing an electronic component according to the present disclosure will be described below with reference to a case where the electronic component is a coil component such as an inductor. However, the method described below is only one example, and the method for manufacturing an electronic component according to the present disclosure is not limited to the following method.

(Preparation of the Magnetic Sheet)

A magnetic sheet is produced by mixing metal magnetic powder, a thermosetting resin, a solvent, or the like at a predetermined ratio and molding the mixture into a sheet shape. Methyl ethyl ketone (MEK), N, N-dimethylformamide (DMF), propylene glycol monomethyl ether (PGM), or the like may be used as the solvent.

(Preparation for Marker Paste)

An inorganic filler, a thermosetting resin, a solvent, and the like are mixed in a predetermined ratio to produce a marker paste. Methyl ethyl ketone (MEK), N, N-dimethylformamide (DMF), propylene glycol monomethyl ether (PGM), or the like may be used as the solvent. Assuming that the total weight of the inorganic filler is 100 wt %, the inorganic filler contained in the marker paste may contain, for example, 10 wt % or more and less than 30 wt % (i.e., from 10 wt % to 30 wt %) of borosilicate glass and 50 wt % or more and 80 wt % or less (i.e., from 50 wt % to 80 wt %) of $TiO_2$, and the balance may contain at least one of $ZrO_2$ and $Al_2O_3$. Note that the composition and average particle size of the inorganic filler contained in the marker paste may be considered to be substantially the same as the composition and average particle size of the inorganic filler contained in the marker of the finished electronic component.

(Production of Element Body)

A coil conductor is prepared, and the magnetic sheet and the coil conductor are overlapped and pressurized to bury the coil conductor into the magnetic sheet. In the case of manufacturing a plurality of coil components at a time, a base material (substrate, mold, film, etc.) on which a plurality of coil conductors are disposed is prepared, and the magnetic sheet is superposed on the base material and pressurized to bury the coil conductors into the magnetic sheet.

First, a plurality of coil conductors are arranged, a magnetic sheet is superposed on the upper surface of the coil conductor and pressurized, and primary press forming is performed. Thereby, at least a part of the coil conductor is buried into the magnetic sheet. The marker paste is applied to the surface of the magnetic sheet by screen printing or the like and dried to form a marker. The position and shape of the marker paste can be set as appropriate in accordance with the shape and position of a desired marker.

Subsequently, another magnetic sheet is superimposed on the lower surface of the coil conductor (the surface where the coil conductor is exposed from the magnetic sheet) and pressurized to perform secondary press forming. In this secondary press forming, a part of the marker is buried into the magnetic sheet. Further, by the secondary press forming, the magnetic sheet superimposed on the upper surface of the coil conductor and pressurized and the magnetic sheet superimposed on the lower surface of the coil conductor and pressurized are formed integrally.

The method for forming the marker is not limited to the method described above, but for example, after the primary press forming and the secondary press forming is performed, the marker paste may be applied to the surface of the magnetic sheet and dried to form a marker, and the magnetic sheet on which the marker is formed is further pressurized to bury a part of the marker into the magnetic sheet. Alternatively, the magnetic paste containing metal magnetic powder and the conductor paste containing metal powder may be sequentially laminated by screen printing or the like to form a laminate having a conductor inside, the surface of the laminate is printed with the marker paste, which is dried to form a marker, and then the laminate may be pressed to bury a part of the marker into the laminate.

Then, after the magnetic sheet with the coil conductor buried therein is cured, the magnetic sheet is cut (dicing, etc.) in accordance with the dimensions of each coil component and is polished (barrel polishing, etc.). Thus, the element body having the conductor (coil conductor) inside is obtained.

When barrel polishing is performed, a part of the metal magnetic powder contained in the element body can adhere to the surface of the marker depending on the processing conditions (speed of rotation and/or processing time) of barrel polishing. When the metal magnetic powder adheres to the surface of the marker, an insulating material can be disposed on the surface of the marker in a step of forming an insulating film to be described later.

(Formation of Insulating Film)

Next, an insulating film is formed on the surface of the element body. The method for forming the insulating film is not particularly limited, but the insulating film can be formed by, for example, the method described in Japanese Patent Application Laid-Open No. 2016-178282. First, a mixed solution is prepared which contains an ionizing component for ionizing a metal constituting the metal magnetic powder contained in the element body, a surfactant, and a resin component. The ionizing component may be, for example, one or more components selected from the group consisting of sulfuric acid, hydrofluoric acid, iron fluoride, nitric acid, hydrochloric acid, phosphoric acid, and carboxylic acid. The surfactant may be, for example, an anionic surfactant such as an alkylbenzene sulfonate or a nonionic surfactant such as a polyoxyethylene alkyl ether. The resin component may be, for example, one or more selected from the group consisting of an acrylic resin, an epoxy resin, a polyimide resin, a silicone resin, a polyamide-imide resin, a polyether ether ketone resin, a fluorine resin, and an acrylic silicone resin. The element body is immersed into the mixed solution. The surface of the element body is etched by the action of the ionizing component contained in the mixed solution, whereby the metal component contained in the metal magnetic powder present on the surface of the element body is ionized. The ionized metal component reacts with the resin component in the mixed solution. By this reaction, the resin components in the mixed solution are neutralized and settle on the surface of the element body, thereby forming an insulating film on the surface of the element body. On the other hand, with the marker not containing the metal magnetic powder, the ionization or the reaction between the ionized metal component and the resin component described above does not occur on the surface of the marker. Therefore, the insulating film can be selectively formed on the surface of the element body on which the marker is not disposed. Note that the insulating film is not formed on the exposure surface of an extended portion where both ends of the coil conductor are extended to the surface of the element body. This is because the constituent element (e.g., Cu, etc.) of the coil conductor is hardly ionized since being a noble element as compared to the metal component of the ionized element body, and as a result, the constituent element is unlikely to react with the resin component.

As described above, at the time of barrel polishing the element body, a part of the metal magnetic powder contained in the element body can adhere to the surface of the marker. In this case, also on the surface of the metal magnetic powder adhering to the surface of the marker, the ionization of the metal magnetic powder and the reaction between the ionized metal component and the resin component can occur, and an insulating material can partially adhere to the surface of the marker. As a result, an insulating material is disposed on the exposure surface of the marker in the finished electronic component. At this time, the insulating material disposed on the exposure surface of the marker may be separated from the insulating film.

Next, the element body having the insulating film formed thereon is washed with pure water or the like and then subjected to heat treatment. By this heat treatment, the resin components contained in the insulating film are crosslinked via a cationic element or between the resin components.

In addition to the method described above, the insulating film may be formed by such a method as follows: a method in which an insulating film is formed on the entire surface of the element body by an arbitrary method, and then the insulating film formed on the surface of the marker and the extended portion of the coil conductor is partially removed by laser irradiation or the like, or a method in which a water repellent treatment is applied to the surface of the marker and the extended portion of the coil conductor, and then the insulating film is formed on the surface of the element body by an arbitrary method.

(Formation of External Electrode)

An external electrode is formed by applying a conductive paste containing metal particles to the element body on which the insulating film is formed. The external electrode may be formed by sputtering, plating, or the like. A plating layer may be further provided on the surface of the external electrode. Thus, the electronic component (coil component) according to the present disclosure can be obtained.

More specifically, for example, in the case of forming a five-face electrode as the external electrode, the external electrode is formed by applying a conductive paste to both end surfaces of the element body and some of four surfaces adjacent to both end surfaces, and firing the conductive paste at a temperature at which the insulating film does not thermally decompose. In this case, the external electrode is disposed on the insulating film.

As another method, for example, in the case of forming an L-shaped electrode as the external electrode, the insulating film on the laser irradiation surface of the element body is removed by irradiating, with laser, a region on the surface of the element body where the external electrode is to be formed, and the metal magnetic powders exposed on the laser irradiation surface are bonded to each other. Next, an external electrode is formed on the laser irradiation surface by plating (electrolytic plating or electroless plating). In this case, the external electrode is disposed directly on the element body.

As yet another method, for example, in the case of forming a bottom electrode as the external electrode, the bottom electrode can be formed by forming an L-shaped electrode by the method described above and then forming an insulating film in a portion located on the end surface of the external electrode by spray coating, dip coating, or the like.

The present disclosure includes the following aspects but is not limited to these aspects:

(Aspect 1)

An electronic component provided with an element body having a conductor inside; an insulating film and at least one marker disposed on a surface of the element body; and an external electrode disposed on the element body or the insulating film. The marker is exposed on a surface of the electronic component. $M_{max}$ and $I_{max}$ satisfy the following expression when the maximum height of the marker on the surface of the element body on which the marker is disposed is $M_{max}$ and the maximum height of the insulating film is $I_{max}$:

$$M_{max} \leq I_{max}.$$

(Aspect 2)

The electronic component according to aspect 1, wherein the marker is in contact with the element body.

(Aspect 3)

The electronic component according to aspect 1 or 2, wherein at least a part of an outer edge of the marker is covered with the insulating film.

(Aspect 4)

The electronic component of any one of aspects 1 to 3, wherein at least a part of the marker is buried in the element body.

(Aspect 5)

The electronic component according to any one of aspects 1 to 4, wherein the element body includes a metal magnetic powder.

(Aspect 6)

The electronic component according to aspect 5, wherein an average particle size of the metal magnetic powder present near the surface of the element body is smaller than an average particle size of the metal magnetic powder present at a center of the element body.

(Aspect 7)

The electronic component according to aspect 5 or 6, wherein the element body further includes a resin.

(Aspect 8)

The electronic component of any one of aspects 1 to 7, wherein the marker has insulation properties.

(Aspect 9)

The electronic component of aspect 8, wherein the marker contains an inorganic filler containing one or more materials selected from the group consisting of borosilicate glass, $TiO_2$, $SiO_2$, ZnO, $ZrO_2$, and $Al_2O_3$.

(Aspect 10)

The electronic component of aspect 9, wherein the marker contains an inorganic filler containing 10 wt % or more and less than 30 wt % (i.e., from 10 wt % to 30 wt %) of borosilicate glass and 50 wt % or more and 80 wt % or less (i.e., from 50 wt % to 80 wt %) of $TiO_2$, and a balance contains at least one of $ZrO_2$ and $Al_2O_3$.

(Aspect 11)

The electronic component according to any one of aspects 1 to 10, wherein an insulating material is disposed on an exposure surface on which the marker is exposed on the surface of the electronic component, and the insulating material is separated from the insulating film.

(Aspect 12)

The electronic component according to any one of aspects 1 to 11, wherein the insulating film includes an inorganic filler.

(Aspect 13) The electronic component according to any one of aspects 1 to 12, wherein the element body has a substantially rectangular parallelepiped shape, and outer dimensions of the element body have a length of 1.1 mm or more and 1.6 mm or less (i.e., from 1.1 mm to 1.6 mm), a width of 0.6 mm or more and 1.4 mm or less (i.e., from 0.6 mm to 1.4 mm), and a thickness of 0.5 mm or more and 0.8 mm or less (i.e., from 0.5 mm to 0.8 mm). Also, the marker having a diameter or a length of one side of 0.1 mm or more and 0.4 mm or less (i.e., from 0.1 mm to 0.4 mm) is disposed on at least one surface of the element body.

(Aspect 14)

The electronic component according to any one of aspects 1 to 13, wherein a ratio of an area of the marker to an area of the element body surface on which the marker is disposed is 10% or more and 50% or less (i.e., from 10% to 50%).

(Aspect 15)

The electronic component of any one of aspects 1 to 14, wherein the marker is not present at an outer edge of the element body surface on which the marker is disposed.

(Aspect 16)

The electronic component according to any one of aspects 5 to 7, aspect 9 referring to aspect 8 that refers to any one of aspects 5 to 7, and aspect 10 referring to aspect 9 that refers to aspect 8 referring to any one of aspects 5 to 7, wherein an average particle size of the inorganic filler contained in the marker is 30% or more and 70% or less (i.e., from 30% to 70%) of the average particle size of the metal magnetic powder.

(Aspect 17)

The electronic component according to any one of aspects 1 to 16, wherein the marker is exposed on the surface of the electronic component when viewed from a direction perpendicular to the surface of the element body on which the marker is disposed.

(Aspect 18)

The electronic component according to any one of aspects 1 to 17, wherein a periphery of the marker is surrounded by the insulating film when viewed from a direction perpendicular to the surface of the element body on which the marker is disposed.

The electronic component according to the present disclosure is provided with a marker excellent in visibility and prevented from peeling off, thereby enabling highly accurate mounting.

What is claimed is:

1. An electronic component comprising:

an element body including a conductor inside;

an insulating film and at least one marker disposed on a surface of the element body, such that the marker is exposed on a surface of the electronic component; and an external electrode disposed on the element body or the insulating film, the insulating film has a higher insulation property than the element body, the insulating film covers at least a part of the surface of the marker that faces outwardly and the marker extends into the element body below the surface of the element body, and when a maximum height of the marker on the surface of the element body on which the marker is disposed is $M_{max}$ and a maximum height of the insulating film is $I_{max}$, $M_{max}$ and $I_{max}$ satisfy the following expression:

$$M_{max} \leq I_{max}.$$

2. The electronic component according to claim 1, wherein the marker is in contact with the element body.

3. The electronic component according to claim 1, wherein the element body includes a metal magnetic powder.

4. The electronic component according to claim 3, wherein an average particle size of the metal magnetic powder present near the surface of the element body is smaller than an average particle size of the metal magnetic powder present near a center of the element body.

5. The electronic component according to claim 3, wherein the element body further includes a resin.

6. The electronic component according to claim 1, wherein the marker has insulation properties.

7. The electronic component according to claim 6, wherein the marker contains an inorganic filler containing at least one material selected from the group consisting of borosilicate glass, $TiO_2$, $SiO_2$, ZnO, $ZrO_2$, and $Al_2O_3$.

8. The electronic component according to claim 7, wherein the inorganic filler contains from 10 wt % to 30 wt % of borosilicate glass, from 50 wt % to 80 wt % of $TiO_2$, and a balance contains at least one of $ZrO_2$ and $Al_2O_3$.

9. The electronic component according to claim 1, wherein an insulating material is disposed on an exposure surface on which the marker is exposed on the surface of the electronic component, and the insulating material is separated from the insulating film.

10. The electronic component according to claim 1, wherein the insulating film includes an inorganic filler.

11. The electronic component according to claim 1, wherein the element body has a substantially rectangular parallelepiped shape, and outer dimensions of the element body have a length of from 1.1 mm to 1.6 mm, a width of from 0.6 mm to 1.4 mm, and a thickness of from 0.5 mm to 0.8 mm, and the marker having a diameter or a length of one side of from 0.1 mm to 0.4 mm is disposed on at least one surface of the element body.

12. The electronic component according to claim 1, wherein a ratio of an area of the marker to an area of the surface of the element body on which the marker is disposed is from 10% to 50%.

13. The electronic component according to claim 1, wherein the marker is absent from an outer edge of the surface of the element body on which the marker is disposed.

14. The electronic component according to claim 3, wherein an average particle size of an inorganic filler contained in the marker is in a range of from 30% to 70% of the average particle size of the metal magnetic powder.

15. The electronic component according to claim 1, wherein the marker is exposed on the surface of the electronic component when viewed from a direction perpendicular to the surface of the element body on which the marker is disposed.

16. The electronic component according to claim 1, wherein a periphery of the marker is surrounded by the insulating film when viewed from a direction perpendicular to the surface of the element body on which the marker is disposed.

* * * * *